US010280555B2

(12) United States Patent
Robinson et al.

(10) Patent No.: US 10,280,555 B2
(45) Date of Patent: May 7, 2019

(54) HEATING DEVICE FOR TUMBLE DRYER AND TUMBLE DRYER

(71) Applicant: DBK David + Baader GmbH, Rülzheim (DE)

(72) Inventors: Mark Lee Robinson, Mid Glamorgan (GB); Jeffrey John Stuart Williams, Gwent (GB)

(73) Assignee: DBK David + Baader GmbH, Rülzheim (DE)

( * ) Notice: Subject to any disclaimer, the term of this patent is extended or adjusted under 35 U.S.C. 154(b) by 243 days.

(21) Appl. No.: 15/397,974

(22) Filed: Jan. 4, 2017

(65) Prior Publication Data

US 2017/0191216 A1 Jul. 6, 2017

(30) Foreign Application Priority Data

Jan. 5, 2016 (EP) ..... 16150119

(51) Int. Cl.
*D06F 58/26* (2006.01)
*D06F 58/28* (2006.01)

(52) U.S. Cl.
CPC ..... *D06F 58/26* (2013.01); *D06F 2058/289* (2013.01)

(58) Field of Classification Search
CPC ..... D06F 58/26; D06F 58/20; D06F 58/289; D06F 2058/289; F26B 11/02
USPC ..... 34/595–610
See application file for complete search history.

(56) References Cited

U.S. PATENT DOCUMENTS 4,626,201 A * 12/1986 Grantham ..... D06F 58/263 432/105
4,700,495 A * 10/1987 Drews ..... D06F 58/26 219/400
7,425,688 B2 * 9/2008 Loesch ..... D06F 58/26 219/400
7,946,057 B2 * 5/2011 Dittmer ..... D06F 58/20 34/597
8,245,414 B2 * 8/2012 Watson ..... F26B 9/066 34/218
8,371,040 B2 * 2/2013 Kohne ..... D06F 58/26 34/443
8,438,750 B2 * 5/2013 Dittmer ..... D06F 58/22 134/10
8,726,534 B2 * 5/2014 Chappell ..... F26B 9/003 206/315.1
9,127,399 B2 * 9/2015 Chatot ..... D06F 37/42
(Continued)

FOREIGN PATENT DOCUMENTS

EP 1593772 A1 * 11/2005 ..... D06F 58/26
EP 1538255 B1 3/2006
(Continued)

OTHER PUBLICATIONS

European Search Report for EP16150119 dated Jun. 13, 2016 (9 pages).

*Primary Examiner* — Stephen M Gravini
(74) *Attorney, Agent, or Firm* — Bejin Bieneman PLC

(57) ABSTRACT

A heating device for a rear wall of a tumble dryer is disclosed, wherein the heating device includes an electric heating arrangement which may be formed of heating coils. A bypass airflow which is not directly heated by the heating arrangement flows in addition in the housing so that the heat loss through the housing is reduced.

17 Claims, 6 Drawing Sheets

(56) References Cited

U.S. PATENT DOCUMENTS

Figure 1:
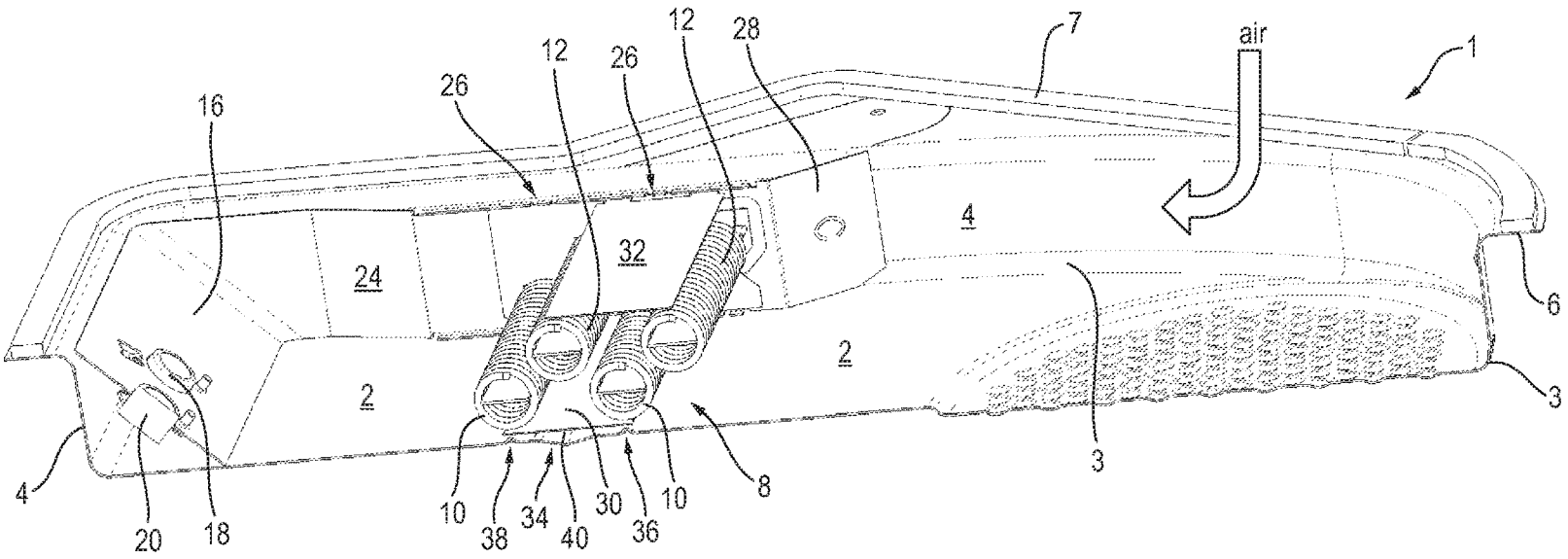

| | | | | |
|---|---|---|---|---|
| 9,297,493 | B2 * | 3/2016 | Bison | D06F 58/06 |
| 2005/0262885 | A1 * | 12/2005 | Byun | D06F 25/00 68/19.2 |
| 2007/0006479 | A1 * | 1/2007 | Salgado-Mangual | A47L 15/486 34/134 |
| 2009/0113742 | A1 | 5/2009 | Kim | |
| 2017/0191216 | A1 * | 7/2017 | Robinson | D06F 58/26 |

FOREIGN PATENT DOCUMENTS

| | | | | |
|---|---|---|---|---|
| EP | 2307838 | B1 * | 1/2017 | E04B 1/7069 |
| GB | 810945 | A | 3/1959 | |
| GB | 2462066 | A * | 1/2010 | E04B 1/7069 |
| GB | 2498456 | A | 7/2013 | |
| JP | 2007330354 | A | 12/2007 | |
| WO | WO 2010007380 | A3 * | 11/2010 | E04B 1/7069 |

* cited by examiner

HEATING DEVICE FOR TUMBLE DRYER AND TUMBLE DRYER

CROSS-REFERENCE TO RELATED APPLICATIONS

This application claims priority to European Patent Application No. EP 16 150 119.2-1710 filed on Jan. 5, 2016, which application is hereby incorporated herein by reference in its entirety.

DESCRIPTION

The disclosure relates to a heating device for a tumble dryer. The disclosure further relates to a corresponding tumble dryer.

From the state of the art tumble dryers are known which heat the airflow and guide the heated airflow through laundry to be dried so that the heated airflow absorbs the humidity of the laundry. There are known, for example, vented dryers which vent the humid airflow afterwards to the environment. Furthermore, dryers including a condenser are known for example, wherein the airflow is dehumidified again in the condenser so that the airflow then can be reheated in a circuit and can be circulated through the laundry again.

The airflow may be heated in a separate housing which is integrated in or attached to a rear wall of the tumble dryer.

In the patent specification EP 1 538 255 B1 a heating device integrated in the rear wall of a tumble dryer is disclosed. It includes a trough-like housing forming a portion of the rear wall of the tumble dryer. A heat shield in which the heating elements are accommodated is inserted in the housing. The airflow to be heated is guided through the heat shield and hence through the heating elements.

It is a drawback of said heating devices that the temperature of the housing constituting the outer wall of the tumble dryer in question can get hot in spite of the heat shield member which means a significant energy loss of the heating devices via the outer wall.

Compared to this, the object underlying the disclosure is to provide a heating device and a tumble dryer in which the heat loss and the energy loss are further reduced at the housing.

This object is achieved by a heating device as described below.

The claimed heating device includes a housing configured to be mounted on a housing wall—preferably rear wall—of a tumble dryer. Inside the housing of the heating device a heating arrangement which may be formed by plural heating coils is accommodated. A main airflow to be heated is guided through the heating arrangement. Moreover, a heat shield can be inserted in the housing between the heating arrangement and the housing. At least one aperture is provided which permits bypass airflow or air bleed branched off or discharged from the total airflow. The bypass airflow or air bleed is not guided through the heating arrangement so that its temperature is lower than that of a main airflow guided through the heating arrangement. Thus the bypass airflow or air bleed cools the housing so that the risk of burns for users is definitely reduced. The bypass airflow or air bleed acts as a thermal insulator reducing heat loss through the rear wall and improving the efficiency of the heating device. In addition, also the risk of harmful heat impact on e.g. power cables or plastic tubes of a tumble dryer in question which are (maybe accidentally) in contact with the outside of the housing is definitely reduced.

Further advantageous configurations of the invention are described below.

If the heat shield is provided it serves as a separating element between the main airflow (on one side) and the bypass airflow or air bleed (on the other side).

For efficient cooling it is sufficient when the branched-off bypass airflow is considerably smaller than the main airflow, i.e. when the bypass airflow amounts to e.g. less than 15% of the main airflow.

Preferably the aperture is provided between the heat shield and the housing.

The heat shield can be further developed to constitute a two-sided heat protection member or a circumferential (e.g. four-sided) tubular or tunnel-shaped heat protection member.

In terms of devices, it is simple when the housing includes a full-surface main wall and when the heat shield equally is a full-surface member so that it is arranged adjacent and preferably approximately in parallel to the main wall. Then the main wall and the heat shield are spaced from each other and thus can define a cross-section of the aperture.

The distance between the main wall and the heat shield and thus the cross-section of the aperture can be defined, in terms of devices, simply by at least one projection, especially by plural projections. The projection(s) extend(s) from the main wall toward the heat shield so that the heat shield contacts the projections.

Further a bulge extending outwardly and approximately transversely to the two airflows is preferred on the main wall. In this way the stability of the main wall of the e.g. deep-drawn housing is increased. The bulge is preferably disposed in the area of the heating arrangement, preferably in parallel to the heating coils thereof.

The bulge is preferably arranged approximately centrally between at least one upstream projection and at least one downstream projection.

An especially preferred development of the heating device includes a temperature sensor or thermostat which is arranged downstream of the heat shield. Then the bypass airflow can reach the temperature sensor or thermostat so that the latter has to be designed for lower temperatures. When the temperature sensor or thermostat is arranged in an area of the housing spaced apart from the heat shield, the thermal load of the temperature sensor or thermostat can be further reduced. Additionally the temperature sensor or thermostat can be designed for lower temperatures which means it is more sensitive to a safety situation where overheat could occur due to loss of airflow.

When the temperature sensor is mounted on a flow deflecting element (e.g. a baffle) inserted downstream of the heat shield or in the area of the housing spaced apart from the heat shield into said housing, the temperature sensor may protrude on the rear side from the flow deflecting element into a free space and the free space creates space for power cables.

Preferably the flow deflecting element is inclined relative to the main wall so that the two airflows are guided away therefrom and are deflected in the direction of the tumble dryer. Especially also the bypass airflow is guided via the baffle, as it flows along the main wall. Thus the portion of the bypass airflow reached by the temperature sensor is large. In this way the thermal load of the temperature sensor can be further reduced. Additionally the temperature sensor can be designed for lower temperatures which means it is more sensitive to a safety situation where overheat could occur due to loss of airflow.

At the flow deflecting element a temperature limiter and/or thermostat may be arranged as well. They may protrude on the rear side into the free space due to the inclination of the flow deflecting element and space for power cables is created.

According to a further development, the temperature sensor and/or the thermostat is designed for lower temperatures and is cooled by the bypass airflow. For this reason the heating device it is more sensitive to a safety situation where overheat could occur due to loss of airflow.

In terms of manufacture and especially in terms of safe electric insulation for the heating coils, it is of advantage when the heat shield is made of micanite.

In a further development at least one flat-shaped flow baffle which is inclined relative to a (respective) wall portion of the housing is provided upstream of the heating arrangement. Preferably the (respective) wall portion is perpendicular to the main wall. Thus the airflow extending along the respective wall portion is guided to the heating arrangement. The at least one flow baffle preferably is also made of micanite or of sheet metal.

According to a first variant, the heat shield is shorter than the heating arrangement or as long as the heating arrangement in the flow direction. In particular, the heat shield is shorter than the diameters of two neighboring heat coils including a distance between said two heat coils.

According to a second variant, the heat shield is longer than the heating arrangement in the flow direction and projects therefrom in and against the flow direction.

There may be provided e.g. three projections upstream of the heating arrangement and three projections downstream of the heating arrangement. Also, there may be provided, for example, three projections upstream and one projection downstream of the heating arrangement.

In a preferred development the heat shield is clamped between the projections and the heating arrangement, especially one or two outer heating coils. The heat shield may be slightly bent.

In a transition region from the main wall to the wall portion perpendicular thereto preferably screws by which the heat shield is mounted on the housing are inserted. Preferably also the heating arrangement is mounted on the housing via these screws.

In one configuration the housing has a border arranged approximately in parallel to the main wall. The border includes through-holes for fastening means, or fastening means by which the afore-described heating device can be fastened to the tumble dryer are disposed on the border.

The tumble dryer according to the invention includes a rear wall to which the border of the afore-described heating device is mounted.

Figure 2:
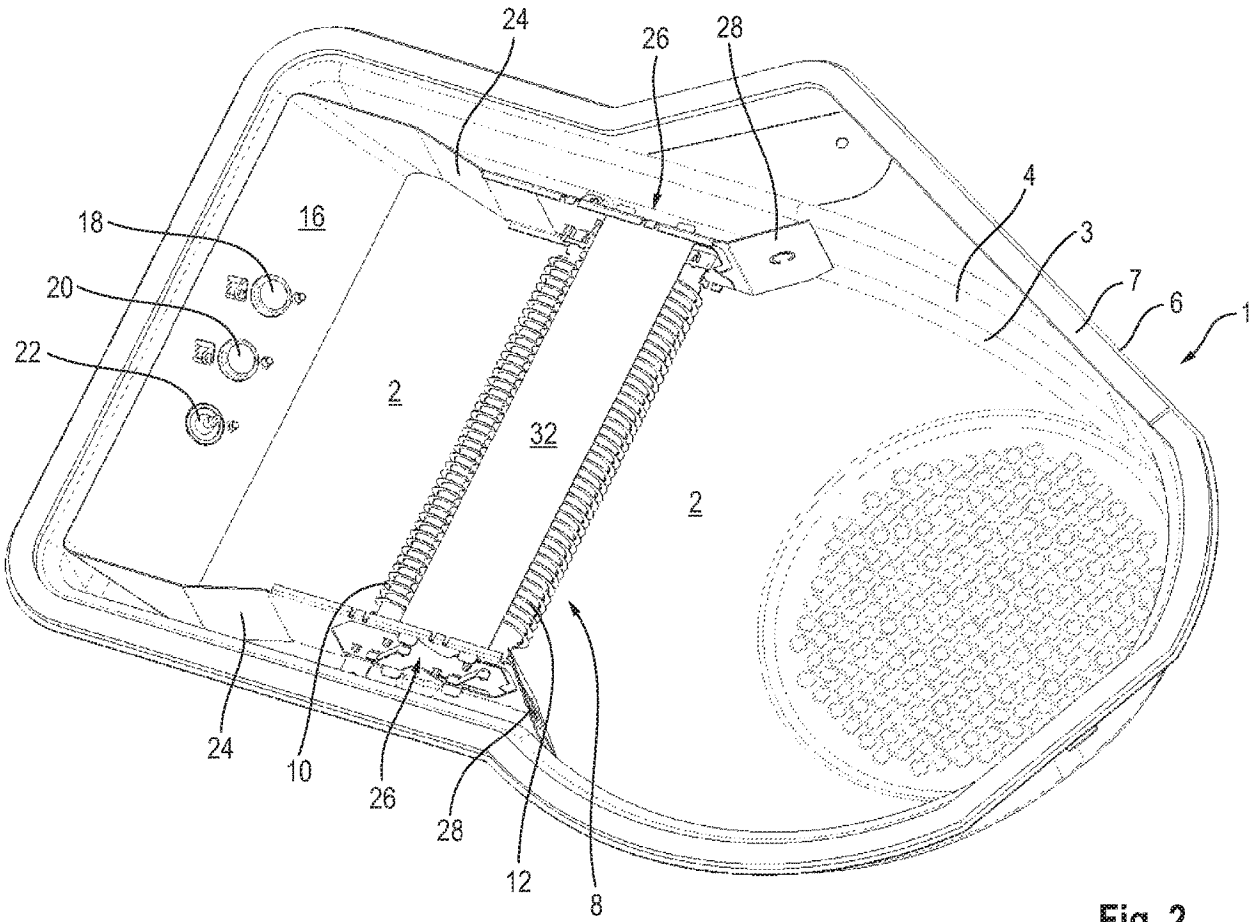
Figure 3:
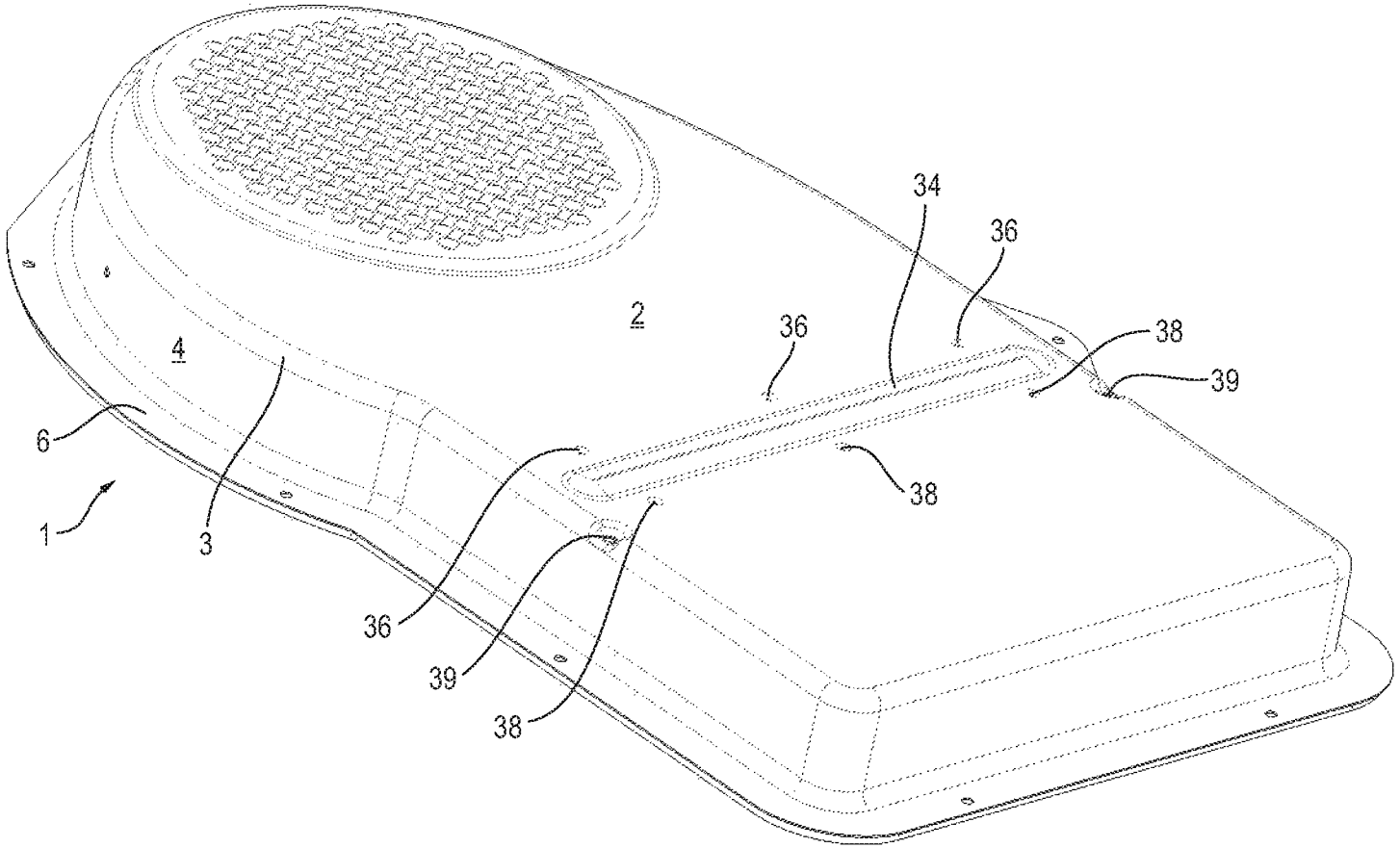
Figure 4:
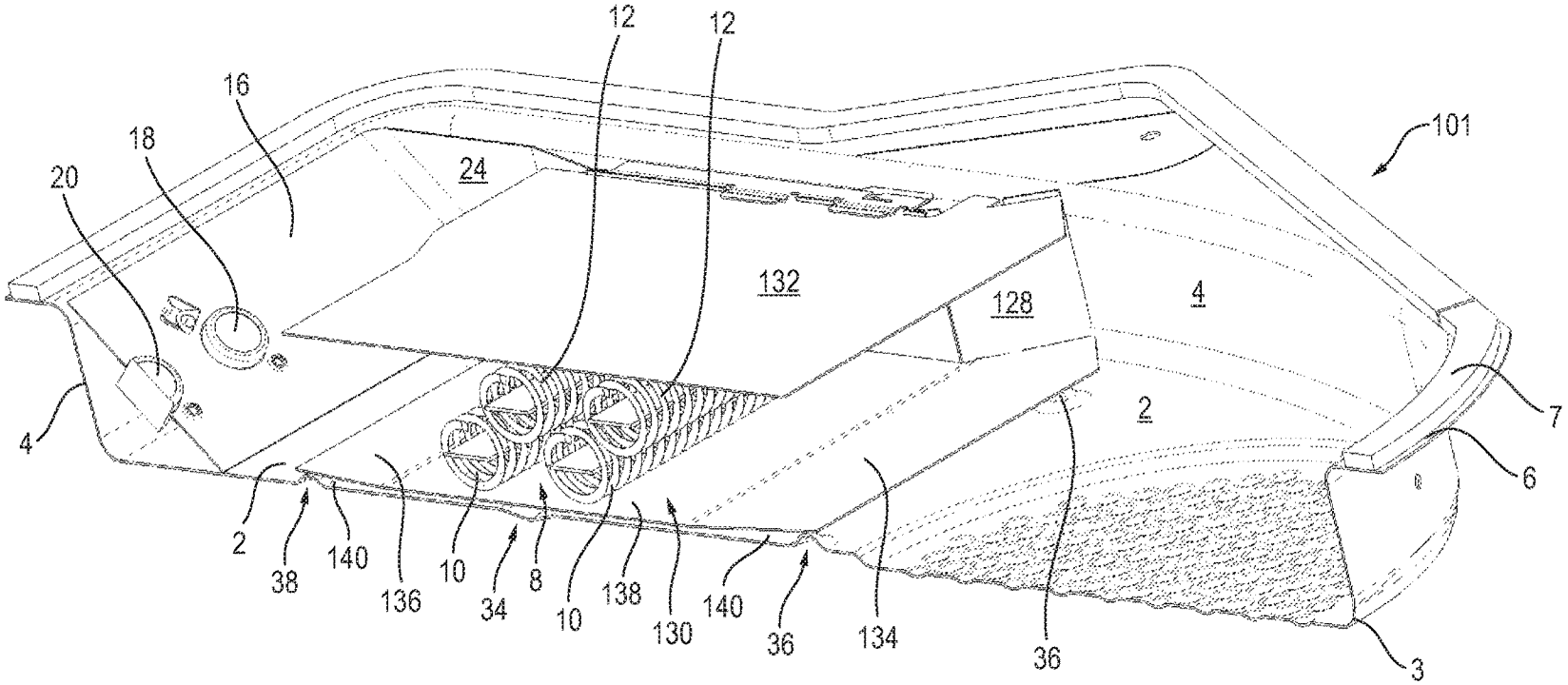
Figure 5:
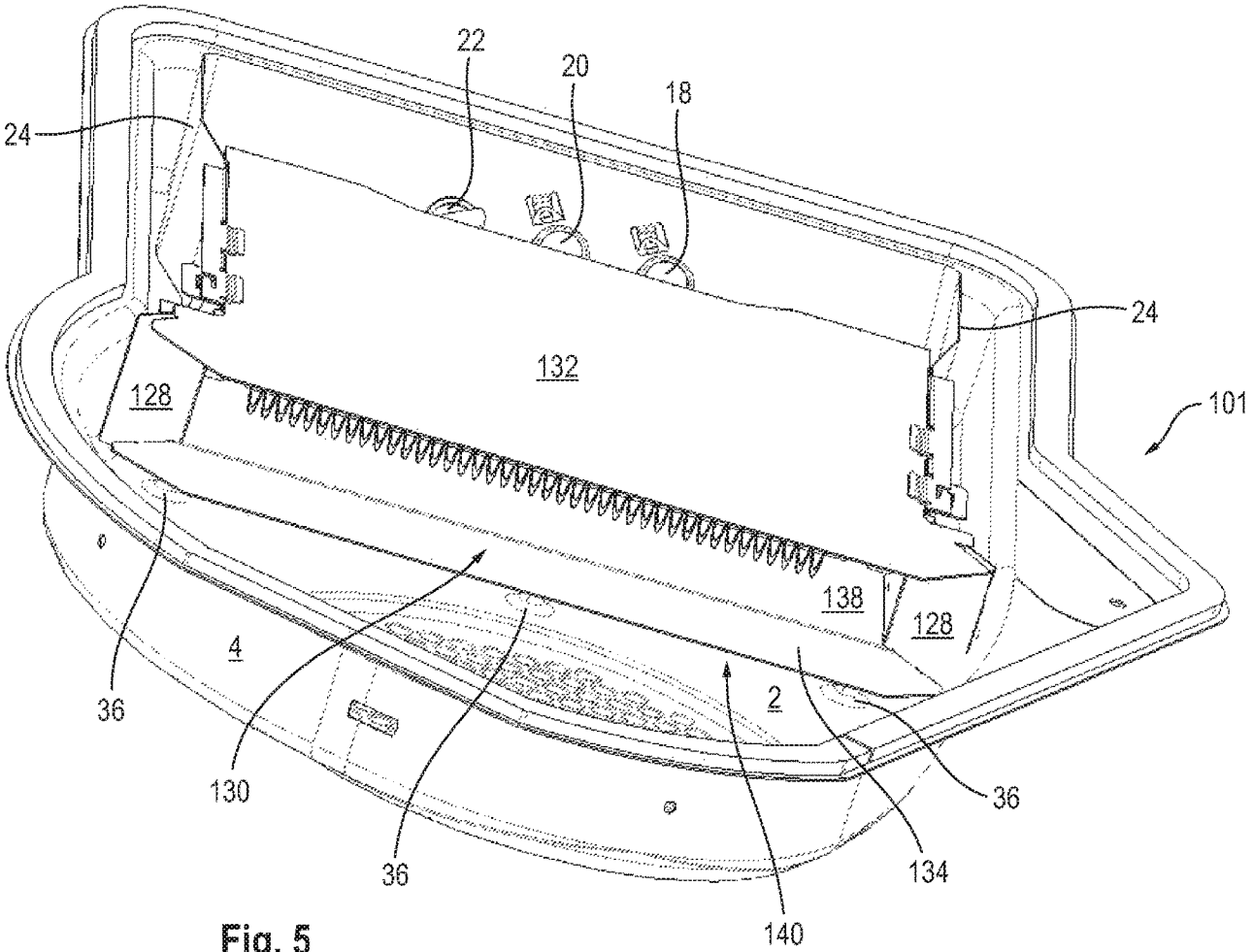
Figure 6:
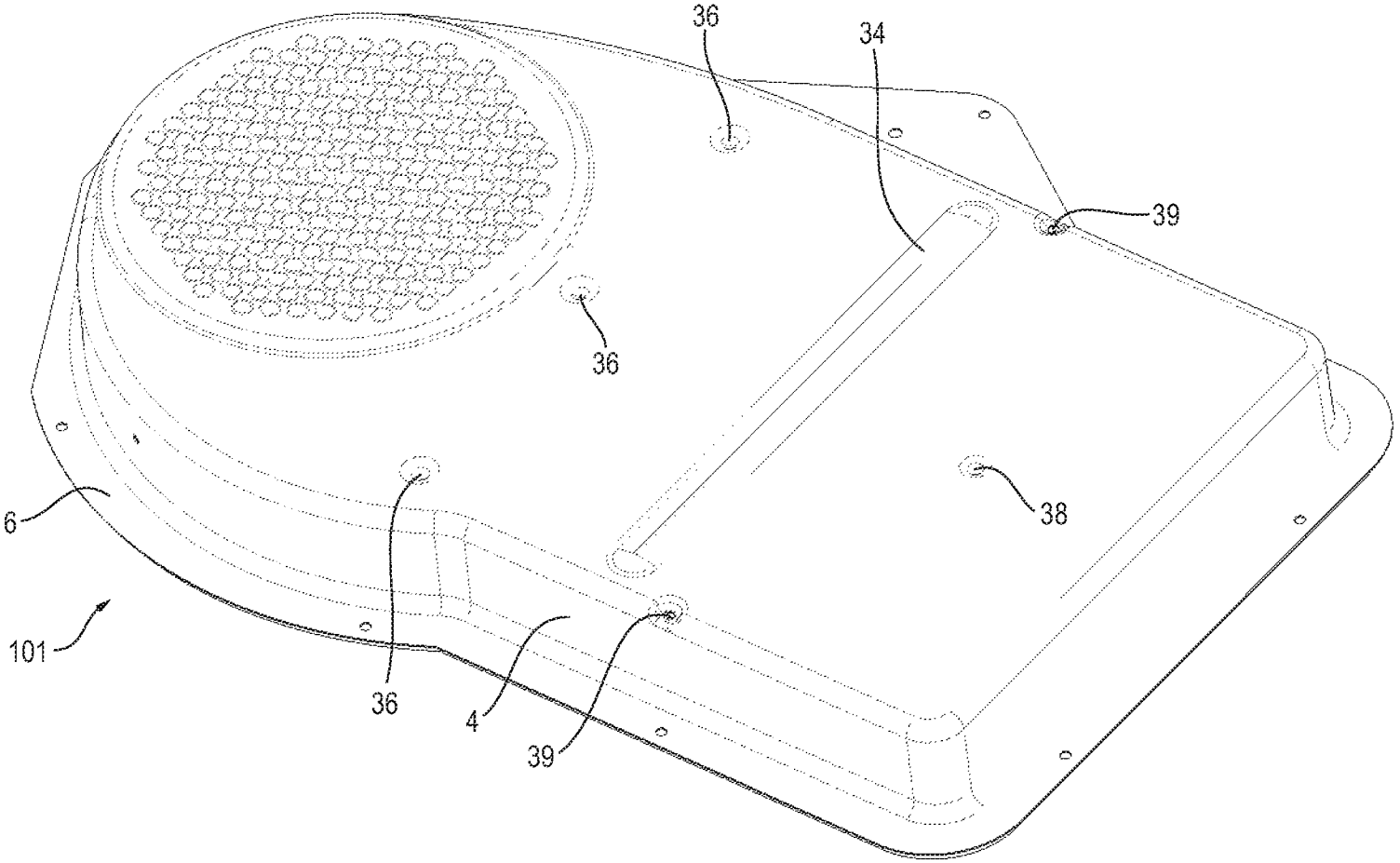

In the figures several embodiments of a heating device according to the invention are illustrated. The invention will hereinafter be illustrated by way of the figures, in which FIG. 1 shows a perspective sectional view of a first embodiment of the heating device according to the disclosure, FIG. 2 shows a perspective view of the first embodiment of the heating device of FIG. 1, FIG. 3 shows a further perspective view from outside of the first embodiment of the heating device of FIG. 1, FIG. 4 shows a perspective sectional view of a second embodiment of the heating device according to the disclosure, FIG. 5 shows a perspective view of the second embodiment of the heating device of FIG. 4, and FIG. 6 shows a perspective view from outside of the second embodiment of the heating device of FIG. 4.

FIG. 1 shows in a perspective sectional view a first embodiment of the heating device according to the disclosure. It comprises a trough-like housing 1 including an outer comparably large main wall 2 which turns into a circumferential wall portion 4 via a rounded transition region 3. The circumferential wall portion 4 is approximately perpendicular to the main wall 2. Via a further rounded transition region the peripheral wall portion 4 turns into a border 6 arranged approximately in parallel to the main wall 2. The border 6 is mounted to a rear wall of the housing of a tumble dryer (not shown). Between the border 6 and the housing of the tumble dryer a seal 7 is provided.

In the housing 1 a heating arrangement 8 consisting of a total of four heating coils 10, 12 is provided. Two heating coils 10 are arranged adjacent to the main wall 2 and are referred to as outer heating coils 10, as in the mounted state of the heating device they are located on the outside. The two other heating coils 12 are referred to as inner heating coils 12, as they are arranged adjacent to the tumble dryer.

Ambient air is sucked via an impeller of a fan (not shown) into the interior of the housing 1 according to the arrow shown in FIG. 1 and is delivered downwards by the heating coils 10, 12. Downstream of the heating coils 10, 12 the total airflow is deflected via a flow deflecting element 16 (to the left in FIG. 1) in the direction of an entry into the tumble dryer. The flow deflecting element 16 is inclined by approximately 45° with respect to the main wall 2 and to the neighboring wall portion 4. A temperature limiter 18 and a thermostat 20 are inserted in the flow deflecting element 16. It is evident from FIG. 1 that due to the inclination of the flow deflecting element 16 a rear free space is formed into which the temperature limiter 18 and the thermostat 20 extend in portions.

FIG. 2 illustrates in a further perspective view the heating device according to FIG. 1. It is evident that in addition to the temperature limiter 18 and the thermostat 20 a temperature sensor 22 is inserted in the flow deflecting element 16.

The flow deflecting element 16 includes connecting portions 24 bent on both sides, each being connected to a retaining device 26. Between the two retaining devices 26 the heating arrangement 8 is accommodated. Furthermore, a flow baffle 28 which is inclined with respect to the neighboring wall portion 4 and guides the total airflow upstream of the heating arrangement 8 in the direction of the heating arrangement 8 is fastened or formed upstream of each retaining device 26.

FIG. 1 illustrates that an outer strip-shaped micanite element 30 and an inner strip-shaped micanite element 32 extend between the two retaining devices 26, only one of which is shown in FIG. 1. Both micanite elements 30, 32 serve as heat shield and especially as electric insulation for the heating coils 10, 12. Both micanite elements 30, 32 can be equal for the purpose of facilitating manufacture. Both micanite elements 30, 32 extend transversely to the flow direction of the air approximately along the length of the four heating coils 10, 12.

In the flow direction of the air the micanite elements 30, 32 have a width corresponding approximately to the distance of the central axes of the two outer heating coils 10 and consequently also to the distance of the central axes of the two inner heating coils 12. Hence the two micanite elements 30, 32 are shorter in the flow direction than the entire heating arrangement 8.

FIG. 2 illustrates that one of the two inner heating coils 12 and one of the two outer heating coils 10 protrude in the flow direction of the air directed from the top to the bottom in FIG. 2 beyond the inner micanite element 32.

FIG. 3 shows a perspective view of the trough-shaped housing 2 from outside. In the main wall 2 in the area of the heating arrangement (not evident from FIG. 3) a bulge 34 extending approximately over the length of the heating coils 10, 12 or the micanite elements 30, 32 is provided transversely to the flow direction of the air. The bulge 34 is formed to be approximately roof-shaped having two flanks and is rounded at its ends. It extends outwardly, i.e. away from the outer micanite element 30. It serves for stabilizing the main wall 2 of the housing 1 manufactured by a deep-drawing process.

Upstream and downstream of the bulge 34 three respective cam-shaped or approximately conical projections 36, 38 are introduced to the main wall 2.

Moreover, according to FIG. 3 two seats 39 for fastening screws (not shown) by each of which one of the two retaining devices 26 shown in FIG. 2 and thus the heating arrangement 8 are mounted on the housing 1 are provided in the rounded transition region 3 between the main wall 2 and the circumferential wall portion 4.

FIG. 1 shows the central upstream projection 36 and the central downstream projection 38 in a sectional view. Each of said two projections 36, 38 is arranged centrally between the two associated outer projections 36, 38.

The outer micanite element 30 is adjacent to all six projections 36, 38, thereby an aperture 40 for a bypass airflow being formed. According to the invention, the total airflow is divided in two from an air inlet (not shown) to the flow deflecting element 16. More exactly speaking, a larger inner main airflow heated by the heating arrangement 8 is formed between the two micanite elements 30, 32 and a smaller outer bypass airflow not or hardly heated by the heating arrangement 8 is formed through the aperture 40, viz. between the outer micanite element 30 and the main wall 2. Thus the bypass airflow continues flowing along the main wall 2 also to the flow deflecting element 16 and thus especially acts also on the temperature limiter 18, the thermostat 20 and the temperature sensor 22, the latter being configured with negative temperature coefficients (NTC). In this way, said components 18, 20, 22 can be designed for lower heat and thus by simpler devices without the monitoring and control of the heating of the total airflow being impaired. Especially the thermostat 20 and the temperature sensor 22 can be designed for lower temperatures which means they are more sensitive to a safety situation where overheat could occur due to loss of airflow.

When the temperature limiter 18 is heated above a predetermined temperature, it responds so that the heating arrangement is switched off.

FIG. 4 illustrates in a cut perspective representation a second embodiment of the heating device according to the disclosure. The substantial difference from the first embodiment according to FIGS. 1 to 3 has to be perceived in the fact that the inner micanite element 130 and the outer micanite element 132 are broadened in and against the flow direction and thus their width is more than doubled. In this way the two micanite elements 130, 132 surmount the two flow baffles 128 made of sheet metal against the flow direction and extend approximately up to the air inlet. Also downstream of the heating arrangement 8 the micanite elements 130, 132 are extended and surmount the heating arrangement 8.

Being adapted to the broadening of the outer micanite element 130, also the three upstream projections 36 and the merely single downstream projection 38 in this embodiment are positioned at a respective border area 134, 136 of the outer micanite element 130. The outer micanite element 130 is clamped between the outer heating coils 10 and the projections 36, 38 so that the upstream border area 134 and the downstream border area 136 of the outer micanite element 130 are inwardly bent. A central main section 138 of the outer micanite element 130 is tensioned in the direction of the main wall 2 by the two outer heating coils 10.

FIG. 5 shows in a perspective representation viewing approximately along the flow direction the second embodiment according to FIG. 4. It is evident in which way the upstream border area 134 of the outer micanite element 130 is tensioned by the three upstream projections 36 of the main wall 2 in the direction away from the main wall 2, thus the size of the entry of the aperture 140 being defined.

In another perspective representation FIG. 6 illustrates the outside of the housing 101. Accordingly, the distance of the upstream projections 36 from the downstream projection 38 is evident which corresponds approximately to the extension of the inner micanite element 130 and moreover also of the outer micanite element 132.

In both embodiments according to FIGS. 1 through 6, each of the bulge 34 and the projections 36, 38 are manufactured as embossing.

A heating device for a rear wall of a tumble dryer is disclosed, wherein the heating device includes an electric heating arrangement which may be formed by heating coils. The heat impact on a housing which at the same time is a housing of the tumble dryer can be attenuated by means of a heat shield preferably made of micanite. A bypass airflow which is not directly heated by the heating arrangement additionally flows through the housing so that the impact of heat on the housing is further attenuated. The bypass airflow acts as a thermal insulator reducing heat loss through the rear wall and improving the efficiency of the heating device. In addition, also a temperature sensor of a thermostat can be cooled by said bypass airflow so that the maximum heat is not applied to said temperature sensor, either. Additionally the temperature sensor or the complete thermostat can be designed for lower temperatures which means it is more sensitive to a safety situation where overheat could occur due to loss of airflow.

The invention claimed is:

1. A heating device comprising:

a housing configured for attaching to a housing wall of a tumble dryer, wherein a heating arrangement for heating a main airflow is accommodated inside of the housing; and a heat shield arranged inside the housing adjacent to a main wall of the housing between the heating arrangement and the main wall, the heat shield being flat-shaped and forming, together with the main wall of the housing, an aperture through which a bypass airflow is allowed in a flow direction of the main airflow.

2. The heating device according to claim 1, wherein the heat shield is inserted in the housing in an area of the heating arrangement and the aperture is provided between heat shield and the main wall of the housing.

3. The heating device according to claim 1, wherein the aperture is defined by at least one projection which extends from the main wall in the direction of the heat shield and to which the heat shield is adjacent.

4. The heating device according to claim 1, wherein on the main wall a bulge is formed which extends outwardly and approximately transversely to the bypass airflow and the main airflow.

5. The heating device according to claim 3, wherein on the main wall a bulge is formed which extends outwardly and approximately transversely to the bypass airflow and the main airflow.

6. The heating device according to claim 5, wherein the bulge is arranged between at least one projection arranged upstream in a flow direction and at least one projection arranged downstream in the flow direction, the flow direction being a direction of the bypass airflow and the main airflow.

7. The heating device according to claim 1 comprising a temperature sensor arranged downstream of the heat shield in a flow direction, the flow direction being a direction of the bypass airflow and the main airflow.

8. The heating device according to claim 7, wherein the temperature sensor is arranged on a flow deflecting element which is arranged downstream of the heat shield in the flow direction and which is inclined with respect to the main wall such that the bypass airflow and the main airflow are guided away from the main wall.

9. The heating device according to claim 8, wherein at least one of a temperature limiter and a thermostat are disposed on the flow deflecting element.

10. The heating device according to claim 9, wherein at least one of the temperature sensor and the thermostat is cooled by the bypass airflow.

11. The heating device according to claim 1, wherein the heat shield is made of micanite.

12. The heating device according to claim 1, wherein upstream of the heating arrangement in a flow direction, at least one flow baffle is provided which is inclined with respect to a side wall section of the housing, the flow direction being a direction of the bypass airflow and the main airflow.

13. The heating device according to claim 1, wherein in a flow direction the heat shield is one of (a) shorter than the heating arrangement and (b) as long as the heating arrangement, the flow direction being a direction of the bypass airflow and the main airflow.

14. The heating device according to claim 1, wherein the heat shield is longer than the heating arrangement in a flow direction, the flow direction being a direction of the bypass airflow and the main airflow.

15. The heating device according to claim 3, wherein the heat shield is clamped between the projections and the heating arrangement.

16. The heating device according to claim 1, wherein the housing includes a border which is arranged approximately in parallel to the main wall and which includes through-holes configured to receive fasteners.

17. A tumble dryer comprising a heating device including:

a housing configured for attaching to a housing wall of the tumble dryer, wherein a heating arrangement for heating a main airflow is accommodated inside of the housing; and a heat shield arranged inside the housing adjacent to a main wall of the housing between the heating arrangement and the main wall, the heat shield being flat-shaped and forming, together with the main wall of the housing, an aperture through which a bypass airflow is allowed in a flow direction of the main airflow.

* * * * *